United States Patent [19]

Crosby

[11] 4,303,232

[45] Dec. 1, 1981

[54] SEAT SPRING ASSEMBLY (TORQUE-COIL)

[75] Inventor: Lawton H. Crosby, Lake Bluff, Ill.

[73] Assignee: Morley Furniture Spring Corporation, Lake Bluff, Ill.

[21] Appl. No.: 82,104

[22] Filed: Oct. 5, 1979

Related U.S. Application Data

[63] Continuation-in-part of Ser. No. 13,547, Feb. 21, 1979, abandoned.

[51] Int. Cl.[3] ..... F16F 3/10

[52] U.S. Cl. ..... 267/88; 5/263; 267/96; 267/100; 267/112; 297/452

[58] Field of Search ..... 267/88, 91, 96, 99, 267/100, 101, 102, 103, 110, 111, 112, 131, 133, 142, 144, 151, 86; 297/452; 5/263

[56] References Cited

U.S. PATENT DOCUMENTS

| | | | |
|---|---|---|---|
| 1,592,870 | 7/1926 | Scholzen | 267/102 X |
| 1,826,012 | 10/1931 | McElroy | 267/101 X |
| 2,293,563 | 8/1942 | Ruggles | 267/88 |
| 2,649,896 | 8/1953 | Stubnitz | 267/88 |
| 2,680,475 | 6/1954 | Caton | 267/102 X |
| 3,210,064 | 10/1965 | Crosby | 267/103 |
| 3,388,904 | 6/1968 | Crosby et al. | 267/111 |
| 3,624,846 | 12/1971 | Rub | 267/88 X |
| 3,790,149 | 2/1974 | Crosby | 267/110 |
| 3,942,777 | 3/1976 | Mardusky et al. | 267/102 |

FOREIGN PATENT DOCUMENTS

| | | | |
|---|---|---|---|
| 1209606 | 9/1959 | France | 267/88 |

*Primary Examiner*—George E. A. Halvosa
*Attorney, Agent, or Firm*—Richard G. Lione

[57] ABSTRACT

A coil seat spring assembly wherein spring coils are mounted on a plurality of sinuous spring bands extending between the front and back rails of a furniture seat frame. The axes of the coils are substantially vertical. The coils on each band are clamped to each other and to adjacent coils and adjacent bands at their uppermost coil turns and at their lowermost coil turns. The coils are approximately two-thirds the axial length of conventional coil springs.

1 Claim, 6 Drawing Figures

2.
2.
A
40a
40b
40c
40d
61
66
48
52
51
50
49
47
46
45
40
60
21a
21b
21
22
20
15
10
11
13
12
30
65
33
34
35
21x
21y
21z 1.
1.
40b
66
61
65
60
13
51
56
47
21
20
21a
30
22
40
11

SEAT SPRING ASSEMBLY (TORQUE-COIL)

RELATED APPLICATIONS

This application is a continuation-in-part of co-pending application Ser. No. 13,547, now abandoned.

FIELD OF THE INVENTION

This invention relates in general to furniture seat spring assemblies. It relates particularly to seat spring assemblies which employ coil springs of one type or another.

BACKGROUND OF THE INVENTION

Seat spring assemblies made up of coil springs have been in use for many years in upholstered furniture seats. In their eight-way, hand-tied configuration, coils springs have produced the best "seat" thought possible in the furniture industry since spring cushioned furniture made its appearance. There have been no real improvements in coil spring assemblies for almost as long as such assemblies have been in use, at least not insofar as the development of an even better "seat" is concerned.

SUMMARY OF THE INVENTION

The present invention is embodied in a coil seat spring assembly which produces a marked increase in comfort over all existing coil seat spring assemblies. It is, accordingly, an object of the present invention to provide a new and improved seat spring assembly for upholstered furniture. It is another object to provide such a new and improved seat spring assembly which employs coils springs in either their eight-way, hand-tied configuration, or in their drop-in configuration. It is still another object to provide a new and improved seat spring assembly which produces a more comfortable seat than traditional drop-in or hand-tied coil springs. It is yet another object to provide a seat spring assembly of the aforedescribed character which can be produced at a lower cost than conventional coil spring assemblies.

The foregoing and other objects are realized in accord with the present invention by providing a seat spring assembly wherein spring coils are mounted in a prescribed fashion on a plurality of sinuous spring bands extending between the front and back rails of a furniture seat frame. The sinuous spring bands support the coils, providing vertical resilience under them. Because of the natural, raised profile of the sinuous spring bands, shorter spring coils can be utilized, resulting in the saving of a substantial amount of spring wire in the coils and a concomitant cost saving in the seat spring assembly. There are also major savings in labor over hand-tied coils.

In its simplest form the sinuous spring bands are connected to the back frame rails without torquing elements attached to their back ends or torquing configurations built in. If even more luxurious seating is desired, albeit at a slightly increased price, torsion is introduced to the bands manner illustrated in U.S. Pat. Nos. 3,210,064 or 3,388,904, for example, assigned to the same assignee as the present invention.

In either case, unique spring dynamics are generated by cooperation between the two types of springs, the coil springs mated with sinuous spring bands. The straight compression-expansion spring action of the coil springs cooperates with the rotating compression-reaction operative in the sinuous spring bands to produce unexpected superior seating comfort.

BRIEF DESCRIPTION OF THE DRAWINGS

The invention, including its construction and method of operation, together with additional objects and advantages thereof, is illustrated more or less diagrammatically in the drawings, in which.

DESCRIPTION OF THE PREFERRED EMBODIMENT

Figure 1:
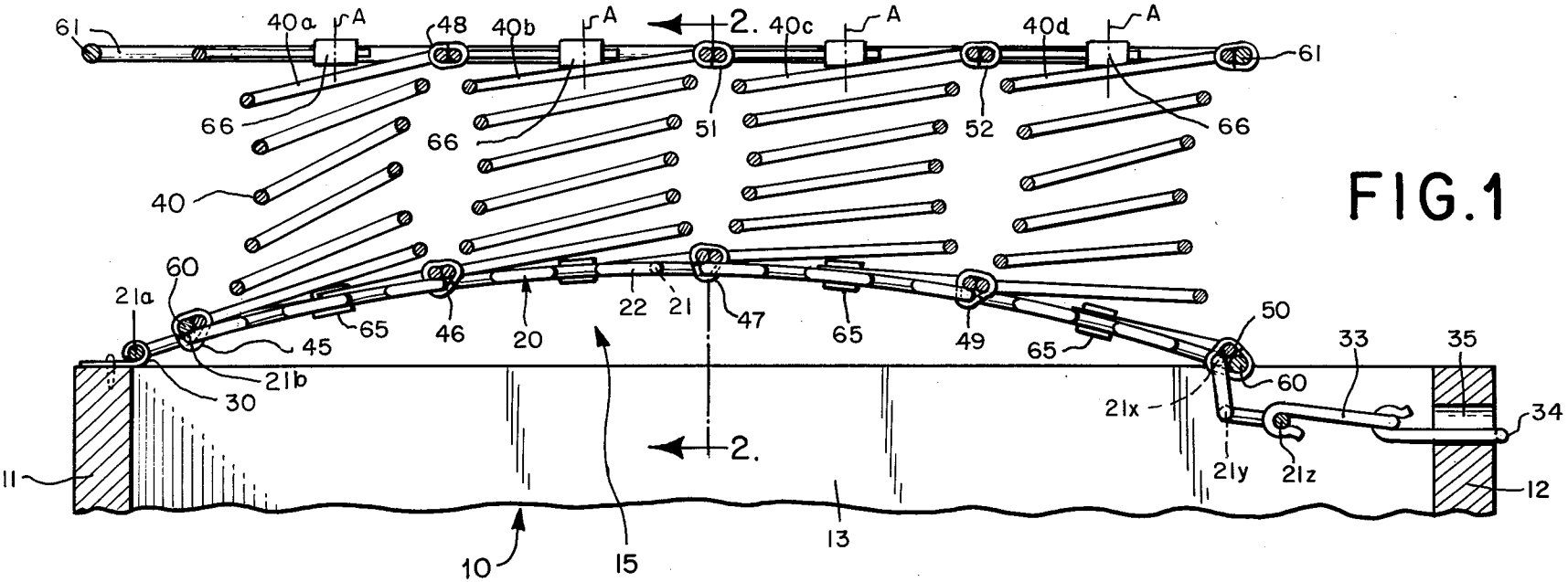
FIG. 1 is a vertical sectional view taken along line 1—1 of FIG. 2 illustrating a seat frame and a furniture seat spring assembly embodying features of the present invention.

Referring now to the drawing, a portion of a furniture seat is seen generally at 10. The furniture seat 10 includes the front rail 11 and a back rail 12 interconnected by side rails 13, each of the rails being fabricated of wood in the present illustration and assembled in a conventional manner. It should be understood, however, that steel or plastic rails might also be used.

According to the invention, the rails 11–13 are of the relatively low profile type normally associated with furniture seats employing coil springs. Mounted within the confines of the rails 11–13, extending between and connected to the front and back rails 11 and 12, is a seat spring assembly 15 embodying features of the invention.

Figure 3:
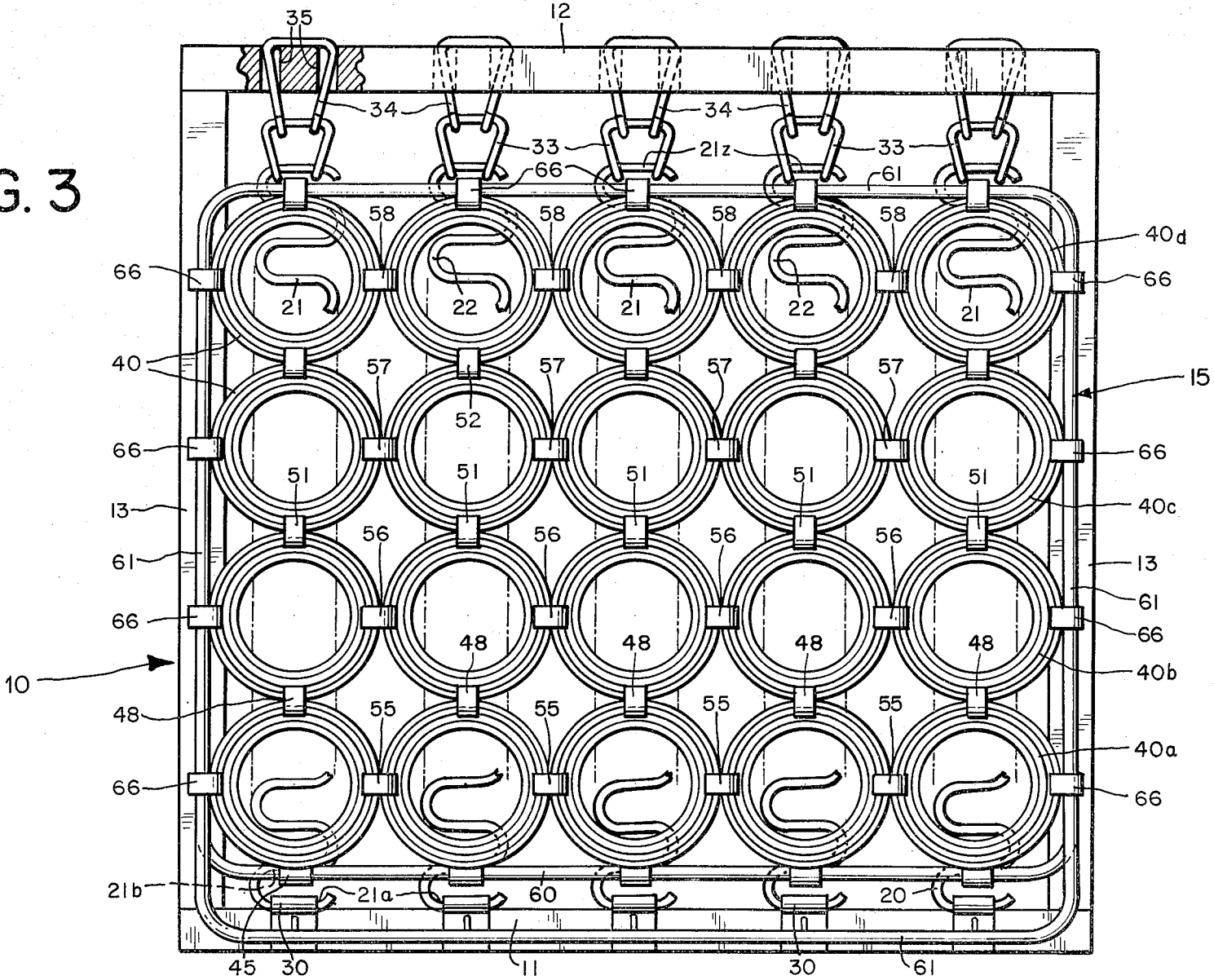
FIG. 3 is a top plan view, in reduced size, of the furniture seat spring assembly illustrated in FIGS. 1 and 2.

The spring assembly 15 includes a series of five sinuous spring bands 20, evenly spaced across the width of the furniture seat 10, as seen in FIG. 3, and connected to the front and back rails at 11 and 12. Referring to FIG. 1, each band 20 includes a plurality of parallel linear wire segments 21 interconnected by generally semi-circular wire segments 22. The normal or relaxed configuration of the band 20 is a circle or portion of a circle which, in use, is stretched out to the profile illustrated in FIG. 1.

Each sinuous spring band 20 is pivotally mounted on the front rail 11 in a conventional EKS clip 30. The forwardmost linear segment 21*a* of the sinuous spring band 20 seats in the clip 30 in a well-known manner.

Each spring band 20 is pivotally connected to the back rail 12 in a manner considerably more sophisticated than that at the front rail. In addition, in the form of the invention illustrated herein, the configuration of the back end of each spring band 20 is modified to introduce torque at the back end of the band in a manner discussed in the aforementioned U.S. Pat. No. 3,388,904, assigned to the same assignee as the present invention.

Specifically, each spring band 20 is bent downwardly at the third linear segment 21*x* from the back end of the band to form, with the body of the band, an interior angle of approximately 120° with the band in place. The band 20 is then bent horizontally outwardly again at the second linear segment 21*y* from its back end so that the ultimate linear segment 21*z* is positioned as illustrated in FIG. 1. This ultimate linear segment 21*z* is then connected to the back rail by a pair of swing anchors 33 and 34 in the manner illustrated at FIG. 4 in U.S. Pat. No. 3,790,149, also assigned to the same assignee as the present invention. It will be seen that in the assembly 15 the swing anchor 34 is connected to the back rail 12 by being seated through a pair of gang bored holes 35 formed horizontally through the back rail one inch below its upper surface.

According to the invention, the spring assembly 15 further includes a series of four coil springs 40 clamped to the upper surface of each sinuous spring band 20 and to each other. Each spring coil 40 is conventional in that it is fabricated of hardened steel wire in a coil having a four inch (4") outside diameter. The coils 40 are no more than two-thirds the overall length of conventional coils, however, being about four inches or less in axial length, and thus employ a maximum of two-thirds the spring steel of conventional coils.

As seen in FIG. 1, the forwardmost coil 40*a* on each band 20 has its lowermost coil turn clamped to the second linear segment 21*b* of the band 20 by the sleeve clamp 45 at its leading edge and to the band 20 at its trailing edge by sleeve clamp 46. Immediately rearward of the coil 40*a* on the band 20, another coil 40*b* is clamped to the band, its lowermost coil turn being clamped at its leading edge in the sleeve clamp 46, and its trailing edge being clamped to the band by another sleeve clamp 47. The adjoining coils 40*a* and 40*b* are also clamped together at their uppermost coil turns by a sleeve clamp 48.

Two more coils, 40*c* and 40*d*, are mounted on each band 20 in a manner identical to coil 40*b*, as also seen in FIG. 1. Sleeve clamp 47 joins coils 40*b* and 40*c* together, as well as to the band 20. Sleeve clamp 49 joins coils 40*c* and 40*d* together, and also to the band 20. The rearwardmost coil 40*d* on each band 20 is fastened to the aforedescribed linear wire segment 21*x* in each sinuous band by another sleeve clamp 50. The uppermost coil turns of the coils 40*b* and 40*c* are clamped together by sleeve clamps 51 and an additional clamp 52 does the same for coils 40*c* and 40*d*.

As seen in FIG. 1, the coils 40*a*–40*d* are tied together in such a way that their axes A are vertical and parallel. Since the band 20 defines an arcuate platform for them, this means that each coil 40 is compressed non-uniformly around its circumference. The two intermediate coils 40*b* and 40*c* are compressed to a greater extent than the end coils 40*a* and 40*d* if all the coils are the same length. In such case the intermediate coils 40*b* and 40*c* in each band are "tied" down to the normal height of the coils 40*a* and 40*d* to assure a uniformly flat cushion support when the seat is not in use. In the alternative, the intermediate coils can be made slightly shorter, three inches (3"), for example.

Figure 2:
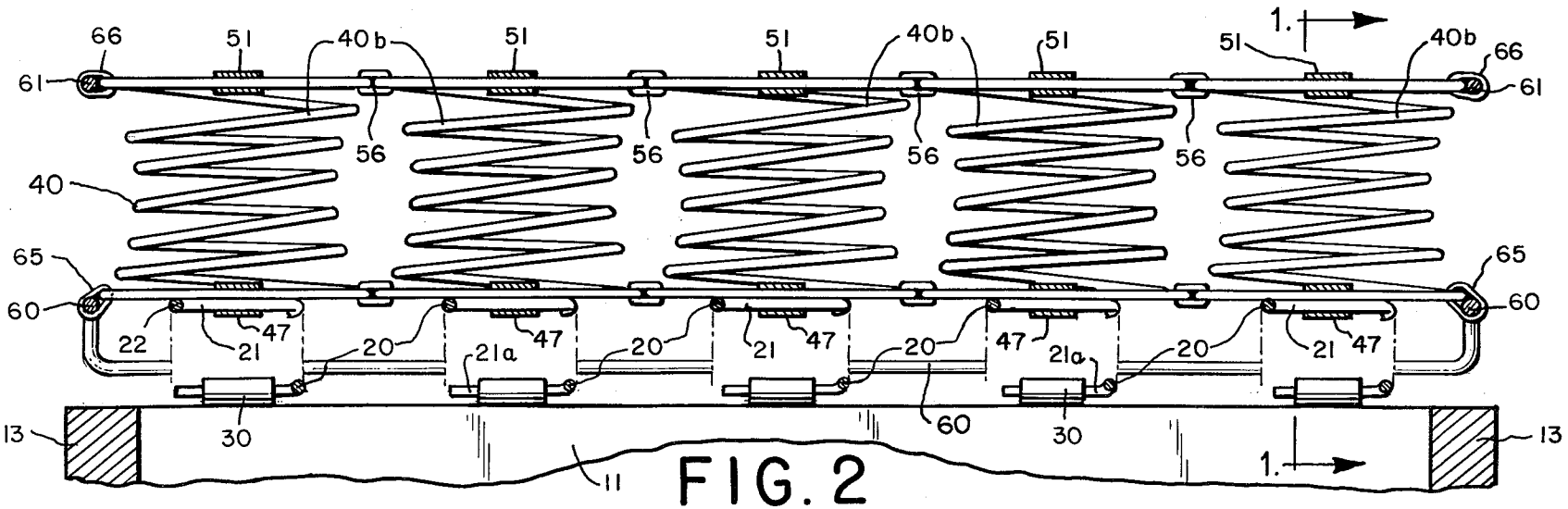
FIG. 2 is a sectional view taken along line 2—2 of FIG. 1.

As seen in FIGS. 2 and 3, the sinuous spring bands 20 are approximately one-half the width of the coils 40; i.e., they are approximately two inches in width. The bands 20 are mounted on the rails 11 and 12 so that they are spaced two inches apart across the width of the seat between the side rails 13. As such, the coils 40 on each band 20 come into immediately adjacent relationship with the coils 40 on the adjacent sinuous spring band 20.

In this relationship, adjacent coils 40*a* are clamped together at their uppermost coil turns by sleeve clamps 55. The uppermost coil turns of the coils 40*b* are clamped together by sleeve clamps 56. Sleeve clamps 57 clamp the uppermost coil turns of the adjoining coils 40*c* together in the same manner. The uppermost coil turns of the coils 40*d* are fastened together in the same manner by sleeve clamps 58. In like fashion, the lowermost coil turns of adjacent coils 40*a* are clamped together, etc.

The spring assembly 15 is completed with border wires 60 and 61. A lower border wire 60 encircles the coils 40 at their lowermost coil turns. An upper border wire 61 encircles the coils 40 at their uppermost coil turns.

The lower border wire 60 is clamped to the leading edges of the lowermost coil turns in corresponding coils 40*a* by clamps 45. It is clamped to the coils 40*d* and corresponding sinuous spring wire segments 21*x* in the aforedescribed sleeve clamps 50. Along the sides of the assembly 15 of the border wire 60 is fastened to corresponding lower coil turns of the coils 40*a*–40*d* with sleeve clamps 65.

The upper border wire 61 is clamped to the upper coil turns of all of the coils 40*a* and 40*d* which border on the sides and back of the spring assembly 15 by similar sleeve clamps 66. As best seen in FIGS. 1 and 3, however, along the front of the assembly 15 the wire 61 is spaced outwardly of the leading edges of the uppermost coil turns in coils 40*a* to the point where it overlies the front surface of the rail 11. By tying the wire 61 along the front to the rail 11 the height of the assembly 15 at its front end can be controlled and cushion gap avoided in a controlled manner. With the coils 40*a*–40*d* fastened together and to the bands 20 in this way they form a substantially flat, horizontal platform for supporting a cushion (not shown).

The symbiotic results of the two spring dynamics coupled in this invention is to give a more rich and luxurious ride, with no bottoming whatsoever, no oil canning, and much more upward resilience and buoyant feeling under load. With torsion inducing bends present in the back of each spring band 20, as illustrated and described, the uplift of the sinuous band platform for the coils is enhanced to a noticeable extent contributing further to the assembly's luxurious seat. By fastening the bands 20 to the back rail 12 an inch or so below the rail top a lower profile is achieved without sacrificing luxury.

The combination of sinuous and coil spring according to the invention substantially reduces labor costs over eight-way, hand-tied individual coils in conventional constructions. The presence of the arced sinuous base eliminates the need for full-height coils. A result is a pronounced saving of material cost.

Figure 4:
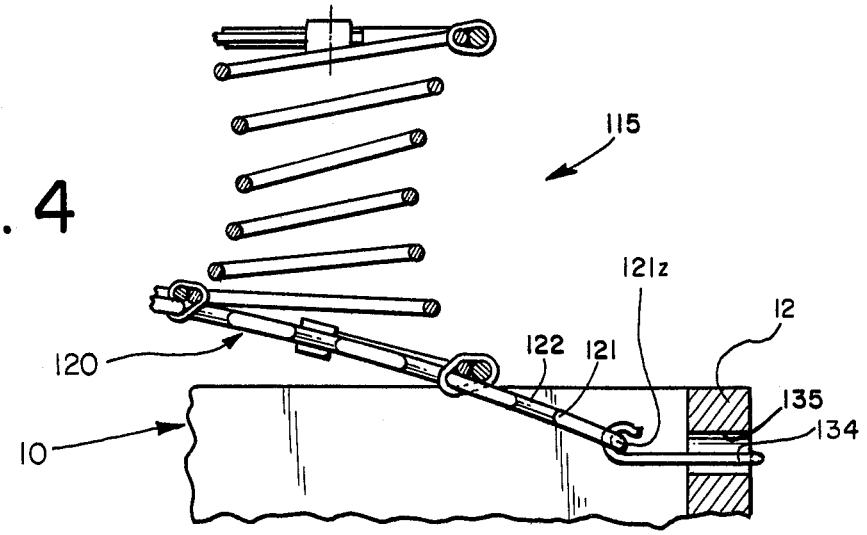
FIG. 4 is a view similar to FIG. 1, but showing only the back portion thereof, illustrating a modified form of the seat spring assembly seen in FIG. 1.
Figure 5:
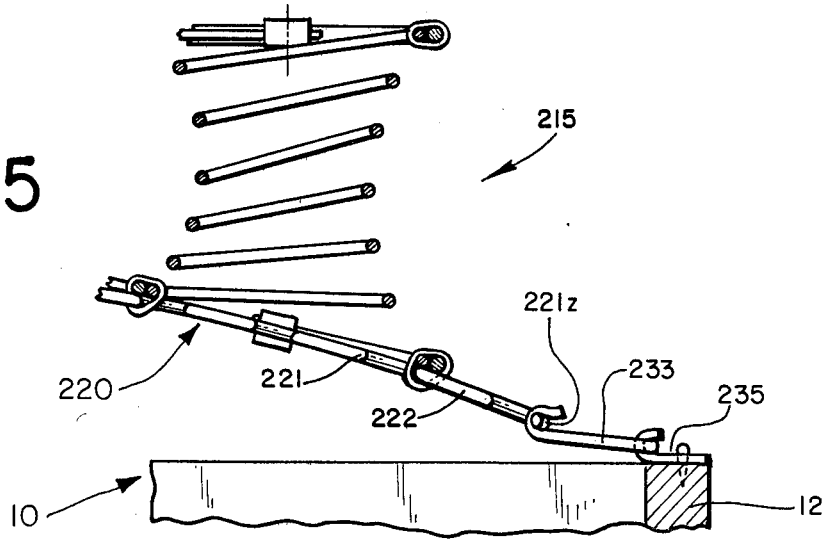
FIG. 5 is a view similar to FIG. 4 illustrating another modified form of the seat assembly seen in FIG. 1.
Figure 6:
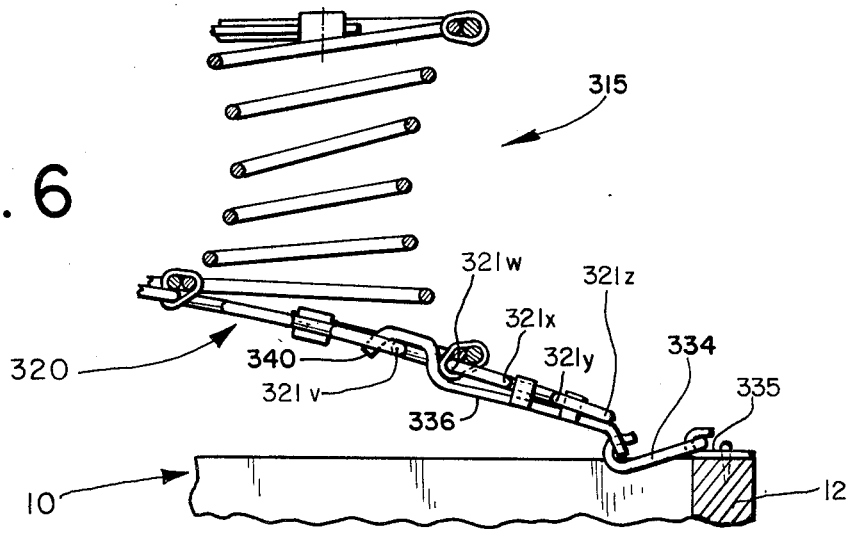
FIG. 6 is a view similar to FIG. 4 illustrating still another modified form of the seat spring assembly seen in FIG. 1.

Turning now to FIGS. 4–6, modified forms of the seat frame and seat spring assembly are illustrated. In FIG. 4 a seat spring assembly 115 in its simplest and least expensive form, without either back rail torsioning or an articulated connection to the back rail 12, is mounted in the seat frame 10. In FIG. 5 a seat spring assembly 215 with an articulated connection to the back rail 12, but no back rail torsioning, is mounted in the seat frame 10. In FIG. 6 a seat spring assembly 315 which produces torsion with a torsion bar and articulated link connection to the back rail 12 is mounted in the seat frame 10.

Referring specifically to FIG. 4, a portion of a seat spring assembly 115 is shown. It includes five (5) sinuous spring bands 120, only one of which is shown, connected to front and back rails, only back rail 12 being shown. Each band 120 includes a plurality of parallel linear wire segments 121 interconnected by generally semicircular wire segments 122. Again, the normal or relaxed configuration of the band 120 is circular.

Each sinuous spring band 120 is pivotally mounted on the front rail in a conventional manner. Each band 120 is pivotally connected to the back rail 12 by a swing anchor 134 mounted on the back rail by being seated through a pair of gang bored holes 135 formed horizontally through the back rail one inch (1") below its upper surface. The swing anchor 134 seats on the ultimate linear segment 121*z* of the spring band, providing a pivoting connection between the end of the spring band 120 and the swing anchor 134 connection with the rail 12.

Referring specifically to FIG. 5, a portion of a spring assembly 215 is shown. It also includes five (5) sinuous spring bands 220, only one of which is shown connected to the back rail 12. Each band 220 includes a plurality of parallel linear wire segments 221 interconnected by generally semicircular wire segments 222. The relaxed configuration of the band 220 is, again, circular.

Each sinuous spring band 220 is pivotally mounted on the front rail in a conventional manner. Each band 220 is connected to the back rail by a swing anchor 233. The swing anchor 233 is connected to the ultimate linear segment 221*z* of the spring 220. The base of the swing anchor 233 is seated in a conventional EK clip 235 on the top of the back rail 12. The result is an articulated, pivot connection between the back end of the spring band 220 and the rail 12 whereby the connection is made on the top of the rail but articulation permits the back end of the band and spring assembly 215 to sink below the rail top level.

Finally, referring specifically to FIG. 6, a portion of a spring assembly 315 is shown. It again includes five (5) sinuous bands 320, but only one is shown. The back end of the sinuous spring band 320 is connected to the top of the back rail 12 by a swing anchor 334, EK clip 335, and torsion bar 336 connection.

The torsion bar 336 corresponds generally to that disclosed in the aforementioned U.S. Pat. No. 3,210,064. The innermost attachment lip 340 of the torsion bar 336 seats over the linear segment 321*v*, which is fifth from the ultimate linear segment 321*z* in the spring band 320. The configuration of the bar 336 is such that it extends down through the band 320 and then underlies linear segments 321*w*, 321*x*, and 321*y*, in addition to the ultimate linear segment 321*z*.

While the embodiments described herein are at present considered to be preferred, it is understood that various other modifications and improvements may be made therein, and it is intended to cover in the appended claims all such modification and improvements as fall within the true spirit and scope of the invention.

What is desired to be claimed and secured by Letters Patent of the United States is:

1. A seat spring assembly for upholstered furniture adapted to be mounted between the front and back rails of a seat frame, comprising:

a. a plurality of sinuous spring bands extending parallel to each other between said front and back rails;

b. each of said sinuous spring bands having a plurality of coil springs mounted on top of it;

c. the axes of said coil springs being disposed substantially vertically when said assembly is mounted between the rails;

d. the lowermost coil turns of each of said coils being clamped to a corresponding sinuous spring band;

e. the uppermost coil turns of each of said coils being clamped to corresponding coil turns of each adjacent coil;

f. an upper border wire extending horizontally around the outer periphery of said coils and being clamped to the uppermost coil turns along the sides of said spring assembly and across the back of said spring assembly;

g. said upper border wire being spaced from the coils across the front of said spring assembly;

h. a lower border wire extending horizontally around the outer periphery of said coils;

i. said lower border wire being clamped to the lowermost coil turns of each coil along the sides, back, and front of said spring assembly;

j. each of said sinuous spring bands having downwardly extending torque arm means associated therewith adjacent the back rail and adapted to induce longitudinal compression in corresponding bands when actuated by the downward movement of the seat spring assembly under load;

k. each of said sinuous spring bands being connected to said back rail by anchor means which pivots about its connection to the back rail so as to permit vertical translatory movement of the back end of the bands under load.

* * * * *